United States Patent [19]

Kubic et al.

[11] 4,445,619

[45] May 1, 1984

[54] PEDAL BIN

[75] Inventors: Nick Kubic, Dollard des Ormeaux; Claude Bell, Boucherville; Serge Seguin, Fabreville, all of Canada

[73] Assignee: Les Produits Menagers Culinaire (Baie d'Urfe) Inc., Baie d'Urfée, Canada

[21] Appl. No.: 466,954

[22] Filed: Feb. 16, 1983

[30] Foreign Application Priority Data

Dec. 23, 1982 [CA] Canada ..... 418422

[51] Int. Cl.[3] ..... B65D 43/26

[52] U.S. Cl. ..... 220/263; 220/1 T; 220/409

[58] Field of Search ..... 220/263, 1 T, 409, 23.83

[56] References Cited

U.S. PATENT DOCUMENTS

| | | | |
|---|---|---|---|
| 1,645,100 | 10/1927 | Geibel | 220/263 |
| 1,820,555 | 8/1931 | Buschman | 220/1 T |
| 2,435,105 | 1/1948 | Solomon | 220/409 |
| 2,759,625 | 8/1956 | Ritter | 220/43 |
| 2,910,206 | 10/1959 | Hodgson | 220/17 |
| 2,946,474 | 7/1960 | Knapp | 220/409 |
| 4,081,105 | 3/1978 | Dagonnet et al. | 220/263 |
| 4,098,429 | 7/1978 | Hodge | 220/331 |
| 4,150,764 | 4/1979 | Anderson | 220/263 |

FOREIGN PATENT DOCUMENTS 1296541 11/1972 United Kingdom .

*Primary Examiner*—Steven M. Pollard
*Attorney, Agent, or Firm*—Robic, Robic & Associates

[57] ABSTRACT

An improved pedal bin of the type comprising a removable basket eccentrically suspended about an axis inside a rigid, upwardly opened box provided with a lid pivotably mounted on one upper flange of said box, in parallel relationship with respect to the suspension axis of the basket and wherein opening of lid is achieved by action of a pedal against the bottom of the basket, to swing it around its suspension axis, and thus move upwardly the end of the basket diagonally opposed to the pedal so as to tilt up the lid. In accordance with the invention the pedal forms an integral part of the basket, and the box is provided with an opening giving free access to the pedal from the outside of the box. The basket is suspended about two pivots located in its forward upper part, each pivot engaging a hinge integral to the box. Tilting up of the lid is obtained through a finger integral to the basket. This finger projects upwardly from the upper flange of the basket adjacent the box flange where the lid is mounted, and has a rounded end coming into contact and following the profile of a cam fixed to the lower part of the lid. The cam is advantageously provided at one end with a stopper to avoid too great opening of the lid.

6 Claims, 3 Drawing Figures

PEDAL BIN

BACKGROUND OF THE INVENTION (a) Field of the Invention

The present invention relates to improvements to pedal bins provided with openable lids.

(b) Brief Description of the Prior Art

British Pat. No. 1,296,541 to Charles Richard Jenkins describes a pedal bin of the type comprising a removable basket suspended inside a rigid, upwardly opened box. The box is provided with a lid mounted to its rear upper flange by means of a pivot. The basket is suspended by one of its upper flange to the front upper flange of the box, opposite to the pivot. Opening of the lid is achieved by action on a pedal mounted onto the box, which swings the basket around its suspension axis till its upper flange adjacent the pivot is moved upwardly and comes into contact with a cam which tilts up the lid.

The pedal bin described in this British Patent is in itself original, but has some drawbacks. By way of example, no means are provided to limit the opening of the lid. Thus, the lid may open too much and be prevented from closing back itself. On the other hand, the basket is subjected to unhooking from the front flange of the vertical box. Moreover, the pedal can be accidentally removed from its support as it extends outside the box, and it requires a special manufacturing step involving a non-negligeable part of the final manufacturing cost.

SUMMARY OF THE INVENTION

The object of the present invention is to provide a pedal bin of the above-mentioned type, which however does not have the above mentioned drawbacks.

In accordance with the present invention, this object is achieved with an improved pedal bin comprising a removable basket eccentrically suspended about an axis inside a rigid, upwardly opened box provided with a lid pivotably mounted on one upper flange of this box, in parallel relationship with respect to the suspension axis of the basket, and wherein opening of the lid is achieved by action of a pedal against the bottom of the basket, to swing it around its suspension axis and thus move upwardly the end of the basket diagonally opposed to the pedal, this end being provided with means for tilting up the lid.

The pedal bin according to the invention is improved over the known ones in that:

the pedal forms an integral part of the basket and the box is provided with an opening giving free access to the pedal from the outside of the box;

the basket is suspended about two pivots located in its forward upper part, each pivot engaging a hinge integral to the box; and the means for tilting up the lid comprises a finger integral to the basket, this finger projecting upwardly from the upper flange of the basket adjacent the box flange where the lid is mounted, and having a rounded end coming into contact and following the profile of a cam fixed to the lower part of the lid, this cam being provided at one end with a stopper to avoid too great opening of the lid.

The pedal bin according to the invention advantageously overcomes the above-mentioned drawbacks encountered with the pedal bin of the type described in British Pat. No. 1,296,541. Indeed, the fact that the pedal forms an integral part of the basket, makes it no longer subject to be accidentally removed from its support, and makes unnecessary the need of an additional manufacturing step. The fact that the basket is suspended inside the box by means of pivots engaging corresponding hinges integral to the box, makes it no longer subject to accidental unhooking from its suspension axis. Additionally, the fact that the means for tilting up the lid of the bin comprises a stopper, permits to avoid too great opening of the lid, which opening may cause the lid to swing backwards and makes impossible its self-closure.

According to a preferred embodiment of the invention, the box is made of a metal sheet and has hinges each having a half-moon structure, obtained by direct stamping of the box. The basket may advantageously be made of a single moulded piece of plastic material, including the pedal, preferably embedded in the basket, the finger and the pivots whose the ends are preferably extended by a knob thereby defining a ball pivot, that may fit within the corresponding hinge on the box. Preferably, the radius of each hinge is slightly greater than the one of the knob in order to ensure self-centering and thus to make easier the operation whereby the basket is set in place inside the box. Preferably, the knobs and hinges have a hemispherical structure.

The lid and the cam may be made of metal and joined together by a spot-welding operation.

The stopper used to prevent too great opening of the lid making it impossible to close the same, may consist of a small arm, extending perpendicularly to the end of the cam profile.

BRIEF DESCRIPTION OF THE DRAWINGS

The present invention will be better understood with reference to the following non-restrictive description of a preferred embodiment thereof, made in connection with the accompanying drawings wherein.

DESCRIPTION OF A PREFERRED EMBODIMENT

Figure 1:
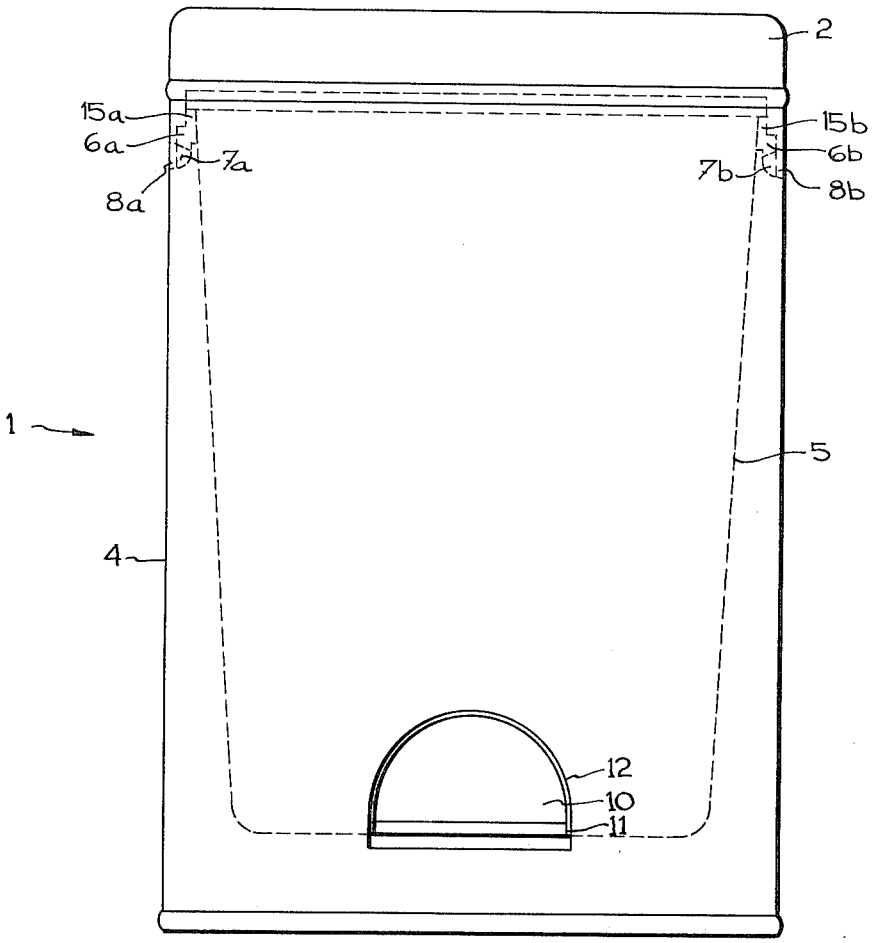
FIG. 1 is a front elevational view of a pedal bin according to the invention, showing the basket in dotted lines.
Figure 2:
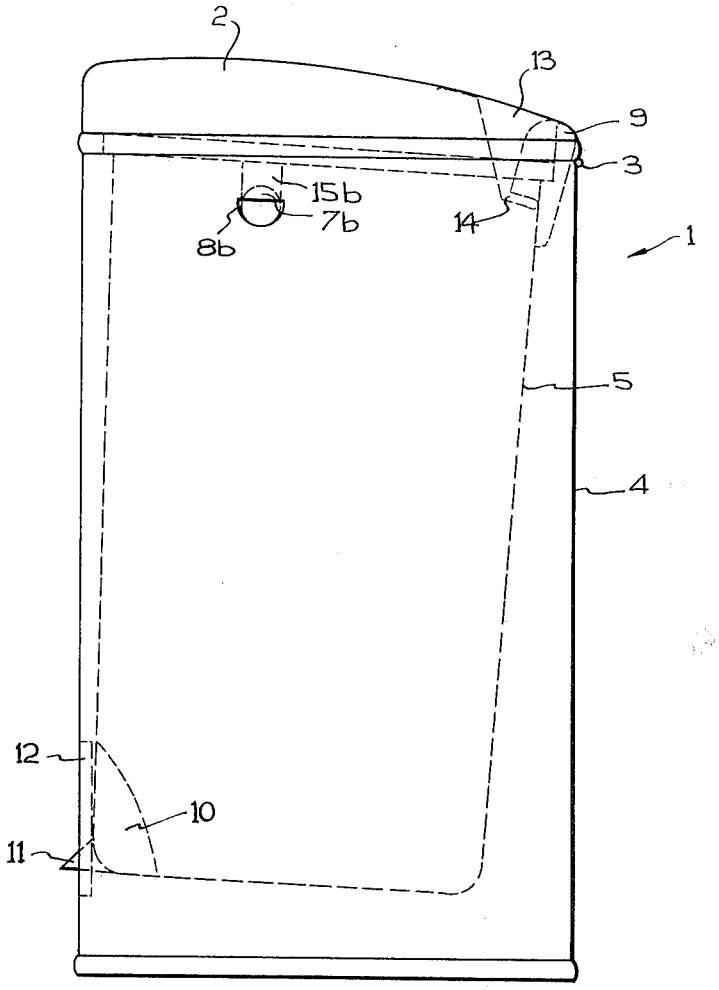
FIG. 2 is a right side elevational view of the bin of FIG. 1.
Figure 3:
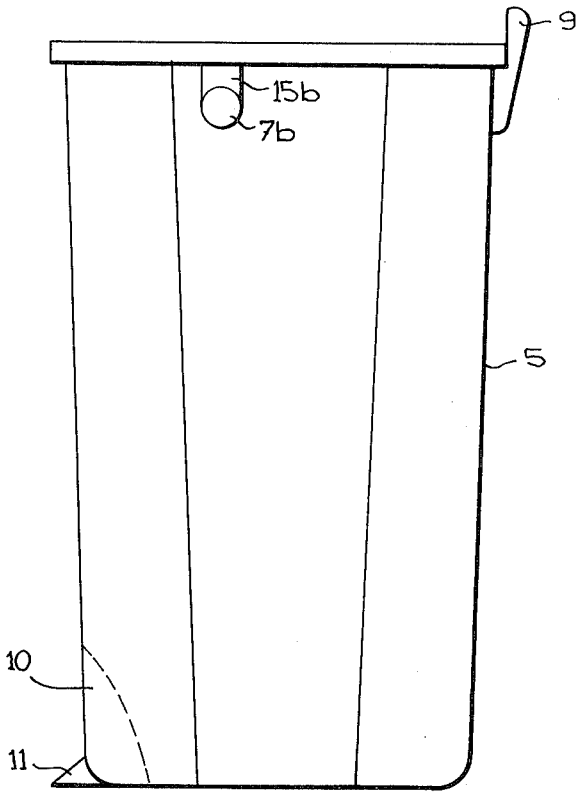
FIG. 3 is a right side elevational view of the basket of the bin of FIG. 1.

The pedal bin 1 shown in the accompanying drawings comprises a lid 2 mounted by means of a pivot 3 on the upper flange of a box 4, and a basket 5 suspended inside the box 4 by means of two coaxial pivots *6a* and *6b* ended respectively by knobs *7a* and *7b* that fit within corresponding hinges *8a* and *8b*.

The pivots *6a* and *6b* integrally project from a pair of vertical reinforcing members *15a* and *15b* respectively, which form part of the walls of the basket 5. The reinforcing members *15a* and *15b* permit to avoid damaging of the walls of the basket 5 from which extend the pivots *6a* and *6b*, as a result of a torsion and/or bending effect due to weight of the basket suspended onto the pivots.

The axis of suspension of the basket 5 is in parallel relationship with respect to the pivot 3, and located in the forward upper part of the basket. This eccentrical suspension of the basket 5 permits a pedal 10 embedded into the lower end of the front wall of the basket to return by mere gravity into its starting position, so that the lid 2 is closed by gravitational rotation of the basket 5 around its suspension axis.

The basket 5 comprises a finger 9 attached onto its rear upper flange adjacent the pivot 3 inside the box 4, and the pedal 10. The pedal 10 comprises a flange 11 passing through an opening 12 provided in the lower part of the front wall of the box 4. The opening 12 and pedal 10 have a sufficient size to allow free access to the extremity of someone's foot.

The finger 9 is intended to come into contact and to follow the profile of a cam 13 spot-welded to the lower part of the lid 2 near the pivot 3. The cam 13 is provided with a stopper 14 extending perpendicularly to its upper end to avoid too great opening of the lid 2.

To open the lid 2, one may engage the tip of one of his or her shoes onto the pedal 10 and push the basket inside the box. Then, the basket swings about its suspension axis as defined by the pivots 6*a* and 6*b*, the knobs 7*a* and 7*b* and the hinges 8*a* and 8*b*. Swinging of the basket brings the finger 9 into contact with the cam 13 and makes it to tilt up the lid 2 until it contacts the stopper 14 which stops tilting up of the lid 2.

To close the lid 2, one can remove his or her shoe tip from the pedal 10. The eccentrical suspension of the basket 5 causes its weight to swing it back together with the pedal into the starting position. The finger 9 disengages the cam 13 and the lid 3 is then allowed to close back by its own weight.

To remove the basket 5 from the box 4, one may tilt up the lid 2 in the above-mentioned manner, and manually lifts the basket 5 upwardly after having disengaged the finger 9 from the cam 13. To reinsert the basket 5 inside the box 4, one may tilt up manually the lid 2, replaces the knobs 7*a* and 7*b* of the basket respectively in the hinges 8*a* and 8*b* of the box, and manually closes the lid 2.

What is claimed is:

1. In a pedal bin of the type comprising a removable basket eccentrically suspended about an axis inside a rigid upwardly opened box provided with a lid pivotably mounted on one upper flange of said box, in parallel relationship with respect to the suspension axis of the basket, opening of said lid being achieved by action of a pedal against the bottom of the basket to swing it around its suspension axis, said swinging moving upwardly the end of the basket diagonally opposed to the pedal, said end being provided with means for tilting up the lid, the improvements wherein:

the pedal forms an integral part of the basket and the box is provided with an opening giving free access to the pedal from the outside of said box;

the basket is suspended about two pivots located in its forward upper part, each pivot engaging a hinge integral to the box; and said means for tilting up the lid comprises a finger integral to the basket, said finger projecting upwardly from the upper flange of the basket adjacent the upper flange of the box where the lid is mounted, and having a rounded end coming into contact and following the profile of a cam fixed to the lower part of the lid, said cam being provided, at one end with a stopper to avoid too great opening of the lid.

2. A pedal bin according to claim 1, wherein the box is made of a metal sheet and the hinges have a half-moon structure and are obtained by direct stamping of the box.

3. A pedal bin according to claim 2, wherein the cam is made of metal and is spot-welded to the lid.

4. A pedal bin according to claim 1, wherein the basket, the pedal, the finger and the pivots are made of a single moulded piece of plastic material.

5. A pedal bin according to claim 4, wherein each pivot is a ball pivot which fits within its corresponding hinge.

6. A pedal bin according to claim 1, wherein the pedal is embedded in the basket.

* * * * *